US006193766B1

(12) United States Patent
Jordan

(10) Patent No.: US 6,193,766 B1
(45) **Date of Patent: *Feb. 27, 2001**

(54) ALFALFA EXTRACT FUEL ADDITIVE FOR REDUCING POLLUTANT EMISSIONS

(75) Inventor: Frederick L. Jordan, Santa Ana, CA (US)

(73) Assignee: Barto/Jordan Company, Inc., Costa Mesa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/036,968

(22) Filed: Mar. 9, 1998

Related U.S. Application Data

(63) Continuation of application No. 08/670,154, filed on Jun. 27, 1996, now abandoned.

(51) Int. Cl.[7] ..... C10L 1/18; C10L 1/22
(52) U.S. Cl. ..... 44/308; 44/326
(58) Field of Search ..... 44/307, 308, 326, 44/436, 398

(56) References Cited

U.S. PATENT DOCUMENTS

| | | | |
|---|---|---|---|
| 2,461,807 | 2/1949 | Buxton et al. | 44/308 |
| 3,133,104 | 5/1964 | Johnston et al. | 44/308 |
| 4,158,549 | 6/1979 | Martin | 44/628 |
| 4,185,594 | 1/1980 | Perilstein | 44/326 |
| 4,274,835 | 6/1981 | Jordan | 44/1 |
| 4,300,009 | 11/1981 | Haag et al. | 585/408 |
| 4,415,336 | 11/1983 | Stasi et al. | 44/636 |
| 4,432,771 | 2/1984 | Sawyer, Jr. | 44/280 |
| 4,499,267 | 2/1985 | Scifoni | 44/51 |
| 4,678,860 | 7/1987 | Kuester | 585/14 |
| 4,844,713 | 7/1989 | Yu et al. | 44/300 |
| 5,152,688 | 10/1992 | Cellini | 434/29 |
| 5,154,844 | 10/1992 | Perozzi | 252/47.5 |
| 5,160,506 | 11/1992 | Schur et al. | 44/308 |
| 5,250,081 | 10/1993 | Habeeb et al. | 44/434 |
| 5,277,910 * | 1/1994 | Hidvégi | 424/195.1 |
| 5,284,492 | 2/1994 | Dubin | 44/301 |
| 5,296,007 | 3/1994 | Clough et al. | 44/623 |
| 5,308,365 | 5/1994 | Kessling, Jr. et al. | 44/447 |
| 5,826,369 * | 10/1998 | Jordan | 44/308 |

OTHER PUBLICATIONS

#2128 Chlorophyll, p. 303. *The Merck Index*, Windholz et al, Merck & Co. Inc., 1983.*

* cited by examiner

*Primary Examiner*—Margaret Medley
(74) *Attorney, Agent, or Firm*—Oppenheimer Wolff and Donnelly LLP

(57) ABSTRACT

Alfalfa extract is used as a fuel additive to enhance combustion characteristics of carbonaceous fuels. Among the observed beneficial characteristics are reductions in the level of common pollutants emitted during combustion. The alfalfa extract is dissolved in a naphthenic hydrocarbon and then mixed with a carrier solvent to provide the final fuel additive which is added directly to a wide variety of carbonaceous fuels. Polyethoxylated castor oil surfactants and alkyl nitrate cetane boosters are also used in conjunction with the alfalfa extract to provide enhanced combustion characteristics and reductions in pollutant emissions.

11 Claims, No Drawings

ALFALFA EXTRACT FUEL ADDITIVE FOR REDUCING POLLUTANT EMISSIONS

This is a continuation of application Ser. No. 08/670,154 filed on Jun. 27, 1996, now abandoned.

BACKGROUND OF THE INVENTION

1. Field of the Invention

The present invention relates generally to reducing the amounts of pollutants produced during the combustion of carbonaceous fuels such as gasoline, diesel fuel, fuel oil, and coal. More particularly, the present invention relates to materials that can be added to the fuel prior to combustion in order to reduce the level of pollutants emitted as a result of the combustion process.

2. Description of Related Art

The combustion of carbonaceous fuels is a major source of air pollution. The primary pollutants produced as a result of the combustion of such fuels include carbon monoxide, nitrogen oxides, sulfur oxides, unburned hydrocarbons, particulate matter, and volatile organic compounds.

There is today considerable interest in developing processes for eliminating or substantially reducing the amounts of pollutants that are emitted into the atmosphere as a result of fuel combustion. One approach involves treating the fuel prior to combustion in order to remove pollutant precursors. For example, numerous desulfurization processes have been devised to remove sulfur from fuel oil, coal, and other fuels prior to combustion. Although it is desirable to use preprocessed fuels that are inherently clean-burning, such fuels are expensive to produce.

Another approach to reducing air pollution involves treating the combustion gases to remove pollutants. A wide variety of adsorbents, as well as catalytic materials, have successfully been used for the removal of pollutants from combustion gases, including carbon monoxide, nitrogen oxides, and sulfur oxides. For example, catalytic mufflers have been successfully used in automobiles to reduce pollutant emissions. Other scrubber devices have also been employed with some success in the removal of pollutants from a variety of combustion flue gases.

In addition to the above pollution-control mechanisms, there has also been interest in developing fuel additives that can be mixed with the fuel prior to combustion. The fuel additive participates in the combustion process, and its components act as scavengers or otherwise react with pollutants to convert them into nonpolluting combustion products. An example of this type of fuel additive is disclosed in U.S. Pat. No. 4,274,835, and involves improving combustion efficiency and reducing sulfur combustion emissions from burning coal by the addition of small amounts of chlorophyll, squalane, squalene, carotenoids, or mixtures thereof.

Many other processes have been developed over the years that are also effective in controlling pollutant emissions. However, the importance of reducing the amounts of substances emitted into the air mandates that researchers continue to seek new and improved methods for limiting the pollutants produced as a result of the combustion of carbonaceous fuels.

SUMMARY OF THE INVENTION

The present invention provides a method for reducing the levels of carbon monoxide and oxides of nitrogen and sulfur that are produced during the combustion of carbonaceous fuels including, but not limited to, natural gas, jet fuel, gasoline, no. 1 diesel fuel, and no. 2 diesel fuel; and higher residual fuels including, but not limited to, no. 4 fuel oil, no. 5 light and no. 5 heavy fuel oils, and no. 6 fuel oil (Bunker C). The invention is based upon the discovery that adding alfalfa extract to the fuel prior to combustion results in the reduction of pollutant emissions that would otherwise occur.

As a feature of the present invention, alfalfa extract is dissolved in a naphthenic hydrocarbon to provide an active ingredient mixture which is further mixed with a solvent carrier to form the final fuel additive. Jojoba oil is a preferred naphthenic hydrocarbon which was found to enhance and preserve the beneficial fuel combustion characteristics produced by alfalfa extract. As a further feature of the present invention, polyethoxylated castor oil surfactants and alkyl nitrate cetane boosters are also included in the fuel additive to provide additional component solubilization.

The alfalfa extract additive, in accordance with the present invention, is used to treat the full range of combustible carbonaceous fuels including, but not limited to, natural gas, gasoline, no. 1 diesel fuel and no. 2 diesel fuel; as well as higher residual fuels including, but not limited to, no. 4 fuel oil, no. 5 light and no. 5 heavy fuel oils, no. 6 fuel oil (Bunker C) and coal. Thus, the alfalfa extract fuel additive of the present invention is suitable for use in a wide variety of combustion processes wherein emission of pollutants such as carbon monoxide, nitrogen oxides, sulfur oxides, unburned hydrocarbons, particulate matter, and volatile organic compounds are a problem.

The above-described and many other features and attendant advantages of the present invention will become better understood by reference to the following detailed description.

DETAILED DESCRIPTION OF THE INVENTION

The present invention is based on the discovery that the dark green material which is extracted from alfalfa is an effective combustion additive which, when added to various carbonaceous fuels, increases combustion efficiency and reduces pollutant emissions. As will be described in detail below, alfalfa extracts may be used alone as a fuel additive or they can be combined with other combustion enhancing ingredients to form a wide variety of effective fuel additives.

A wide variety of alfalfa types can be used to form an alfalfa extract in accordance with the present invention. The term "alfalfa" is used to describe herbaceous perennial legumes which belong to the order Rosales. Alfalfa is characterized by a deep tap root and is also known as lucerne. An exemplary variety of alfalfa which may be used to form extracts is buffalo alfalfa. Any of the other common varieties of alfalfa which are grown in large quantities may be used.

At room temperature, alfalfa extract is a dark green waxy solid which is produced by removing the water and organic solvent soluble components from the alfalfa. These soluble components may be extracted by mechanical methods, chemical extraction methods and combinations of the two. It is preferred that a simple mechanical extraction procedure be used. In such a procedure, the alfalfa is compressed between plates, rollers or other mechanical compression devices at elevated temperatures in order to squeeze the dark green alfalfa extract as a liquid from the plants. The alfalfa may be ground up prior to compression or may be ground up and compressed simultaneously. The alfalfa should be fresh and not dried. In order to enhance recovery, the alfalfa may be washed with small amounts of water after mechanical extraction has been completed. The resulting aqueous extract solution can be added to the bulk of the alfalfa extract recovered during the mechanical extraction. Upon cooling to room temperature, the dark green liquid solidifies to form a solid mass. Any conventional process for preparing alfalfa extract may be used provided that dark green chlorophyll-rich extract is obtained.

Alfalfa extracts may be prepared according to the above procedures or they may be purchased commercially from a number of well-known sources in the alfalfa feed art. The alfalfa extract may be added directly to the fuel. However, it is preferred that the alfalfa extract be dissolved in a suitable carrier solvent to form an additive which may include additional ingredients. The resulting additive solution is then added to the fuel. Suitable carrier solvents include various organic liquids such as gasoline, no. 1 diesel fuel, no. 2 diesel fuel, jet fuel, xylene, toluene, cyclic hydrocarbons, hydrocarbon liquids containing cyclic constituents, liquid hydrocarbon fuels, halogenated hydrocarbon solvents (e.g., chloroform, trichloroethylene, etc.), liquid aldehydes, alcohols, and ketones, and even small amounts of water. Any organic solvent may in fact be used provided that it does not adversely increase pollutant emission levels. The preferred carrier solvents are liquid fuels such as gasoline, jet fuel or diesel fuel. Prior to mixing the alfalfa extract with the diesel fuel, jet fuel or gasoline, it is preferred that the extract be dissolved in a naphthenic hydrocarbon, such as jojoba oil.

If desired, cetane boosters (alkyl nitrates, e.g., 2-ethylhexyl nitrate, mixed octyl nitrates, etc.) may be included in the fuel additive at this time. The preferred level of alkyl nitrate cetane booster is from 0.05 to 20% v/v. If desired, the various additional additive ingredients, such as cetane boosters, may be added separately to the fuel. However, it is preferred that all of the additional additives be included with the alfalfa extract in the naphthenic hydrocarbon which is further dissolved in the carrier solvent to form an additive concentrate which is added as a single component to the fuel.

Ditertbutyl peroxide is another combustion enhancer which may be included with alfalfa extract in the fuel additive concentrate. Trans-β-carotene may also be included in the additive, if desired. Synthetic trans-β-carotene is preferred.

A preferred additive is prepared by taking 200 grams of alfalfa extract and mixing it with 37.8 ml of jojoba oil at room temperature. The alfalfa/jojoba mixture is then mixed with sufficient no. 2 diesel fuel to provide 3785 ml (1 gallon) of total additive concentrate. This additive concentrate is added to diesel fuel at a rate of about 1 ml per 3785 ml of fuel. The amount of alfalfa extract used to prepare the additive concentrate can be varied, if desired. The amount of alfalfa extract may range from about 60 to about 300 grams per gallon. However, it is preferred that the amounts used to prepare the 3785 ml of concentrate be no lower than about 100 grams and no higher than about 300 grams. The amount of jojoba oil used should be from 30–50 ml. The range of jojoba oil used may be from about 20–50 ml.

In a further preferred additive, ditertbutyl peroxide, in amounts ranging from 5 to 30 ml, is included in the 3785 ml of additive concentrate. 2-ethyl hexyl nitrate is also preferably included in the additive concentrate in amounts ranging from 0.1 to 5 percent by volume. The above additive using no. 2 diesel fuel as the carrier solvent is especially well-suited for treating diesel fuel. However, the diesel fuel based additive concentrate may also be used to treat other fuels, including coal and other solid carbonaceous materials.

A preferred additive in accordance with the present invention for treating gasoline is prepared in the same manner as the above described diesel based additive except that gasoline is substituted for diesel fuel as the carrier solvent. The amounts of alfalfa extract, jojoba oil and other optional additives which are present in the gasoline carrier are generally lower than the amounts used for the diesel fuel additive, but they may fall within the same ranges as for the diesel fuel additive. The exact amount of each ingredient in the gasoline based additive can be determined by routine experimentation. In a preferred additive, 60–70 grams of alfalfa extract is mixed with 20–40 ml of jojoba oil, 10 ml of ditertbutyl peroxide and 0.1 to 5 percent by volume of 2-ethyl hexyl nitrate. The resulting mixture is dissolved in sufficient gasoline to provide 3785 ml (1 gallon) of additive. This additive is used to treat gasoline at a rate of 1 ml of additive per gallon (3785 ml) of gasoline fuel.

The temperature and pressure at which combustion takes place affects the level of pollutants emitted during a particular combustion process. The effectiveness of the fuel additive in the present invention will also vary depending upon combustion conditions, for example, the fuel to oxygen ratio. As a routine matter of experimentation, one skilled in the art can determine what fuel additive level provides optimum pollutant emission reduction for a given fuel when burned under certain combustion conditions. The additive should be prepared such that the amount of alfalfa extract in the final fuel prior to combustion is between about 0.0001 to 0.1 weight percent. Further, as mentioned previously, the amount of alfalfa extract, jojoba oil, ditertbutyl peroxide, alkyl nitrates and synthetic trans β-carotene, if any, included in the fuel additive can also be determined by routine experimentation to achieve optimum pollutant emission reduction.

The following typical examples are limited to exemplary embodiments involving reduction in pollutant emissions and increased fuel efficiency for liquid fuels such as diesel fuel and gasoline. It will be understood by those skilled in the art that the fuel additives in accordance with the present invention may also be used effectively to reduce pollutant emission levels in other combustible carbonaceous fuels mentioned earlier, as well as other combustible fuels, such as hydrogen.

Examples of practice are as follows:

EXAMPLE 1

Alternation Of Emissions And Fuel Economy Of Non-Oxygenated Gasoline In Catalytic And Non-Catalytic Exhaust Systems With Alfalfa Based Additives This example sets forth the results of emissions testing performed using the standard Environmental Protection Agency (EPA) test protocol known as "Hot 505." Hot 505 is a 505 second EPA defined transient test that includes a hot start.

The fuel used in these examples was a conventional unleaded regular non-oxygenated gasoline. The specifications for the fuel are set forth in Table 1. The additive was prepared by dissolving 68 g of alfalfa extract in 27 ml of jojoba oil. The resulting mixture was then mixed with a sufficient amount of the unleaded gasoline to provide 1 gallon of additive. The alfalfa extract used in this example was obtained from alfalfa which was grown in the Imperial Valley of California. The alfalfa extract was prepared by comminuting and squeezing recently harvested alfalfa to produce a dark green liquid extract which was mixed with jojoba oil as described above.

The vehicles tested were a 1968 Ford F250 Pickup, a non-catalytic vehicle representing Group 1, the oldest of California Air Resources Board's (CARB) four categories of vehicles, and a 1992 Oldsmobile Model 88 representing Group 4, the newest category. All tests were conducted under identical parameters. First, neat fuel baseline values were established on each vehicle. Then each vehicle was run using the same fuel with varying concentrations of additive. The abbreviations used to identify the different amounts of fuel additive and other ingredients which were added to the fuel in the tests are set forth in Table 2. The results of the tests are shown in Tables 3 and 4. As can be seen from the Tables, the additive when used alone or in combination with ditertbutyl peroxide caused substantial decreases of engine emissions and in appreciable fuel economy improvements for non-oxygenated gasoline in both CARB Groups 1 and 4.

TABLE 1

SPECIFICATIONS FOR UNLEADED REGULAR GASOLINE

| TEST | UNIT | TEST METHOD | SPECIFICATION | RESULT |
|---|---|---|---|---|
| API Gravity @ 60° F. | Deg. | D 287 | | 53.8 |
| Color | | | | CLEAR |
| Research Octane | Number | D 2699 | | 91.4 |
| Motor Octane | Number | D 2700 | | 83.3 |
| Antiknock Index (R + M)/2, Min | Number | D 4814 | 87 | 87.35 |
| Lead Content, Max | Gm/Gal | D 3227 | 0.05 | 0.00 |
| Sulfur, Max | PPM | D 4294 | 300 | 36 |
| Aromatics, Max | Vol % | D 1319 | | 43.6 |
| 0.00 | Vol % | D 1319 | | 0.7 |
| Oxidation Stability, Min | Minutes | D 525 | 240 | 400+ |
| Benzene | Vol % | D 3606 | | <4 |
| Existent Gum, Max | mg/100 ml | D 381 | 5 | 0.8 |
| Corrosion, 3 Hrs @ 122° F., Max | Code | D 130 | 1 | 1A |
| Doctor Test | | D 4592 | NEG | NEG |
| Reid Vapor Pressure, Max | PSI | D 5191 | 8.9 | 8.89 |
| V/L (20° F.), Min | Fahrenheit | D 5188 | 140 | 140 |
| Distillation | | D 86 | | |
| IBP | Fahrenheit | | | 106 |
| 10% Evap., Max | Fahrenheit | | 158 | 127 |
| Evap @ 200° F. | Vol % | | | 45 |
| 50% Evap. F | Fahrenheit | | 170–250 | 215 |
| Evap. @ 300° F. | Vol % | | | 84 |
| 90% Evap., Max | Fahrenheit | | 374 | 316 |
| FBP, Max | Fahrenheit | | 437 | 403 |
| Recovered | % | | | 97.5 |
| Residue, Max | % | | 2.0 | 1 |
| Loss | % | | | 1.5 |

TABLE 2

IDENTIFICATION OF ADDITIVES

| | |
|---|---|
| 4A | = 4 ml additive/gallon gasoline |
| AO | = 1 ml additive + 10 ml ditertbutyl peroxide/gallon gasoline |
| 2AO | = 2 ml additive + 10 ml ditertbutyl peroxide/gallon gasoline |
| 2.5AO | = 2.5 ml additive + 10 ml ditertbutyl peroxide/gallon gasoline |
| 3AO | = 3 ml additive + 10 ml ditertbutyl peroxide/gallon gasoline |
| A20 | = 1 ml additive + 20 ml ditertbutyl peroxide/gallon gasoline |
| 4AO | = 4 ml additive + 10 ml ditertbutyl peroxide/gallon gasoline |
| 2A20 | = 2 ml additive + 20 ml ditertbutyl peroxide/gallon gasoline |
| 3A20 | = 3 ml additive + 20 ml ditertbutyl peroxide/gallon gasoline |
| 4A20 | = 4 ml additive + 20 ml ditertbutyl peroxide/gallon gasoline |
| 4A30 | = 4 ml additive + 30 ml ditertbutyl peroxide/gallon gasoline |

TABLE 2-continued

IDENTIFICATION OF ADDITIVES

| | |
|---|---|
| 5A20 | = 5 ml additive + 20 ml ditertbutyl peroxide/gallon gasoline |
| 5A20 + 10% | = 5 ml additive + 10% ditertbutyl peroxide/gallon gasoline |
| 6A20 | = 6 ml additive + 20 ml ditertbutyl peroxide/gallon gasoline |
| 6A20 + 10% | = 6 ml additive + 10% ditertbutyl peroxide/gallon gasoline |

TABLE 3

Ford F250 Pickup

| Additive | THC | CO | NOx | NMHC | MPG |
|---|---|---|---|---|---|
| Neat | 8.802 | 100.9 | 4.236 | 8.156 | 10.04 |
| 4A | 7.149 | 84.2 | 5.201 | 6.669 | 10.43 |
| AO | 7.866 | 95.9 | 4.690 | 7.317 | 10.40 |
| 2AO | 7.768 | 90.7 | 4.906 | 7.253 | 10.34 |
| 3AO | 7.392 | 88.5 | 5.025 | 6.883 | 10.37 |
| 2A20 | 7.690 | 91.2 | 4.797 | 7.155 | 10.42 |
| A20 | 7.799 | 90.8 | 4.444 | 7.246 | 10.16 |
| 3AO | 7.748 | 87.3 | 4.940 | 7.217 | 10.23 |
| 5A20 + 10% | 8.611 | 101.1 | 4.522 | 7.992 | 10.67 |
| 6A20 | 7.752 | 89.1 | 5.542 | 7.226 | 10.60 |
| 6A20 + 10% | 7.289 | 89.8 | 5.419 | 6.777 | 10.61 |
| 4AO | 7.187 | 83.4 | 5.332 | 6.688 | 10.56 |
| 3AO | 7.140 | 85.1 | 5.098 | 6.633 | 10.44 |
| 2AO | 7.125 | 87.5 | 4.800 | 6.622 | 10.41 |
| 2A20 | 6.698 | 83.2 | 5.061 | 6.228 | 10.62 |
| 3A20 | 6.593 | 84.7 | 4.978 | 6.129 | 10.63 |
| 4A20 | 6.541 | 81.1 | 5.318 | 6.087 | 10.70 |
| 4A30 | 7.062 | 86.3 | 5.602 | 6.567 | 10.05 |

TABLE 4

1992 Oldsmobile 88

| Additive | THC | CO | NOx | NMHC | MPG |
|---|---|---|---|---|---|
| Neat | 0.271 | 12.5 | 0.571 | 0.23 | 19.15 |
| 5A20 | 0.265 | 13.2 | 0.477 | 0.222 | 19.26 |
| 2.5AO | 0.261 | 13.1 | 0.469 | 0.217 | 19.39 |
| 2AO | 0.249 | 10.5 | 0.566 | 0.21 | 18.71 |
| 3AO | 0.265 | 10.3 | 0.458 | 0.225 | 19.87 |
| 4AO | 0.222 | 9.6 | 0.424 | 0.183 | 20.13 |

EXAMPLE 2

Demonstration Of Emission Reduction During Combustion Of No. 2 Diesel Fuel

The following example demonstrates the use of the fuel additive in accordance with the present invention to reduce emissions of pollutants during combustion of no. 2 diesel fuel in a diesel engine.

The diesel engine used for this example was a two-cycle, two-cylinder 33-horsepower Detroit diesel engine, model No. 253. The engine was coupled to an M&W dynamometer, model No. P-400B. The fuel used for this example was a no. 2 diesel that was supplied by Paramount Petroleum (Costa Mesa, Calif.). The fuel specifications for the no. 2 diesel are provided in Table 5.

TABLE 5

SPECIFICATIONS FOR PARAMOUNT No. 2 DIESEL FUEL

| Parameter | Value |
|---|---|
| Gravity, API @ 60° F. | 32.2 |
| Appearance | 4B |
| Color, ASTM | 1.5 |
| Corrosion, 3 hr @ 212° F. | 1-A |
| Flash Point, PMMC, ° F. | 174 |
| Cloud Point, ° F. | 18 |
| Pour Point, ° F. | 0 |
| Viscosity, SUS, @ 100° F. | 38.8 |
| Water & Sediment, % v/v | 0 |
| Acid Number, mg KOH/g | 0.003 |
| Mercaptan Sulfur, ppm RSH | 3 |
| Ash, % w/w | 0.001 |
| Carbon Residue, 10% res, % w/w | 0.14 |
| Cetane Index | 47 |
| Sulfur, ppm | 474 |
| Distillation; D-86, ° F. | |
| Initial | 341 |
| 10% | 429 |
| 90% | 632 |
| End Point | 698 |
| Recovery, % | 98.0 |
| Saturates, % v/v | 54 |
| Olefins, % v/v | 2.6 |
| Aromatics, % v/v | 43.4 |

The fuel additive was prepared in the same manner as Example 1. Neat diesel fuel and fuels containing various amounts of additive were kept in separate large-capacity reservoirs to ensure that negligible fuel temperature changes occurred during any given test run. A number of different amounts of additive were used in different diesel fuel samples in the same manner as Example 1.

Prior to every run, the engine oil level, radiator level, and dynamometer hydraulic oil were checked. The engine was then started, and allowed to idle for several minutes until the engine water temperature reached 150° F. At this point, the engine speed and dynamometer load were slowly increased to a predetermined maximum horsepower engine output, and allowed to stabilize. The temperature (hence, viscosity) of the dynamometer hydraulic oil was carefully controlled at 140° F. by adjusting the cooling water flow rate. Once the engine water temperature reached 170° F. and the dynamometer hydraulic oil was stable at 140° F., the dynamometer was set to 400 psi and the engine rpm set and locked at 1725. According to the M&W dynamometer calculator, these values defined an engine loading of 33 hp. Prior to the acquisition of any data, approximately 15 minutes full-load run time was permitted to make fine-tuning adjustments to both the engine and dynamometer so as to ensure that the preselected hp loading remained constant.

At the start of each run, the following parameters were recorded: all ambient conditions, all engine and dynamometer conditions, the time, and the fuel weight. Then, throughout the run, the following data were taken: the pounds of fuel burned, the engine rpm and hp, the dynamometer hydraulic temperature, ambient temperature, the exhaust gas temperature immediately after combustion as well as at the end of the exhaust system, the barometric pressure, and the percent relative humidity. The data were taken every 15 minutes; the run time was 2 hours.

Emissions were monitored with two models of portable combustion analyzer, viz., an Enerac 2000 and a Quintox KM. In doing so, several additional procedures were incorporated into the test protocol. First, the combustion analyzer to be employed was precalibrated to manufacturer's specifications. A ridged mounting fixture was then attached to the end of the exhaust stack to receive the monitor probe. The position of this fixture was located in accordance with the manufacturer's recommendation, and as not altered during a test run. Prior to prompting an analyzer to print emission data, it was necessary for its self-monitoring circuitry to indicate that valid data could be printed. Once this condition was verified, the following were printed out: oxygen ($O_2$), %, carbon monoxide (CO), ppm; air, %; carbon dioxide ($CO_2$), ppm; nitric oxide (NO), ppm; nitrogen dioxide ($NO_2$), ppm; nitrogen oxides ($NO_x$), ppm; sulfur dioxide ($SO_2$), ppm; the net, exhaust, and ambient temperatures, °F; and the date and time. Emissions data were recorded at 15-minute intervals. The analyzer probe was removed from the exhaust gas flow between measurements.

Fuel economy for the various fuel mixtures was measured first. The baseline fuel economy data obtained with untreated no. 2 diesel are provided in Table 6. The average specific fuel consumption (sfc) of the no. 2 diesel was 0.441 lb/hp-hr.

TABLE 6

SERIES OF RUNS TO ESTABLISH A BASELINE FOR EFFICIENCY OF PARAMOUNT No. 2 DIESEL FUEL

| Ave. Barometric Pressure, In Hg | Ave. Rel. Humidity, % | Ave. Ambient Temperature, ° F. | Ave. Exhaust Temperature, ° F. | Time | Total Fuel Used over 2 hr, lb | SFC, lb/hp-hr |
|---|---|---|---|---|---|---|
| 29.80 | 92 | 66 | 733 | AM | 29.00 | 0.439 |
| 30.71 | 55 | 44 | 724 | AM | 28.75 | 0.436 |
| 30.60 | 55 | 45 | 715 | PM | 28.75 | 0.436 |
| 30.50 | 56 | 44 | 725 | AM | 29.00 | 0.439 |
| 30.38 | 54 | 47 | 734 | PM | 29.25 | 0.443 |
| 30.20 | 74 | 54 | 725 | PM | 28.75 | 0.436 |
| 30.21 | 74 | 53 | 741 | AM | 30.00 | 0.455 |
| Baseline Average Specific Fuel Consumption | | | | | | 0.441 |

The tests showed an increase in fuel economy and reduction in emissions when the additive was used alone or in combination with different amounts of ditertbutyl peroxide.

The exhaust gases produced by combustion of the various fuels were also analyzed. To accomplish this, a large stack extension was attached to the existing exhaust stack to act as a collection chamber. Engine emissions were run through the stack extension collection chamber, which contained a single sampling point. The exhaust stream was sampled continuously in accordance with EPA Methods 1–5 for particulate matter, which mandates the use of carbotrap tubes. Also, volatile organic compounds (VOCs) were sampled in accordance with EPA Method TO-1/TO-2, then analyzed by gas chromatography/mass spectrometry (GC/MS). In addition, specific fuel consumption was monitored as outlined previously. The results of a comparison of the emissions from the neat fuel with those from fuel containing various amounts of additive showed, in general, reduction in aromatic VOCs for the treated fuels. Alkane emissions were also reduced. In addition, a reduction in 1,4-dioxane was noted. This known by product of combustion is a highly toxic poison.

The above example demonstrates that the fuel additive of the present invention provides a substantial improvement in specific fuel consumption in no. 2 diesel fuel. In addition, appreciable decreases of a broad range of volatile organic compounds were observed. Further carbon monoxide and, to a lesser extent, nitrogen and sulfur oxides, were also found to be reduced. Thus, the additive favorably impacts the combustion characteristics of no. 2 diesel fuel.

Having thus described the exemplary embodiments of the present invention, it should be noted by those skilled in the art that the disclosures and modifications may be made within the scope of the present invention. Accordingly, the present invention is not limited to the specific embodiments as illustrated herein, but is only limited by the following claims.

What is claimed is:

1. A fuel additive for use in reducing the pollutant emissions produced during combustion of fuel, said fuel additive comprising alfalfa extract and a liquid solvent carrier wherein the concentration of alfalfa extract in said fuel additive is from 60 to 300 grams per 3.875 liters, and wherein the said liquid solvent carrier is selected from the group consisting of jet fuel, no. 2 diesel fuel and gasoline.

2. A fuel additive according to claim 1 wherein said solvent carrier is jet fuel.

3. A fuel additive according to claim 2 which further comprises from about 20 to 50 milliliters of jojoba oil per 3.875 liters of fuel additive.

4. A fuel additive according to claim 3 which comprises from 60 grams to 70 grams of alfalfa extract and from 20 to 40 milliliters of jojoba oil per 3.875 liters of fuel additive.

5. A fuel additive according to claim 1 wherein said solvent carrier comprises no. 2 diesel fuel.

6. A fuel additive according to claim 5 which further comprises an alkyl nitrate cetane booster.

7. A fuel additive according to claim 1 wherein said solvent carrier comprises gasoline.

8. A method for reducing the level of pollution emissions during combustion of a liquid hydrocarbon fuel composition with oxygen, said method comprising the step of adding a fuel additive to said fuel, said fuel additive comprising alfalfa extract and a liquid solvent carrier, wherein the said liquid solvent carrier is selected from the group consisting of jet fuel, no. 2 diesel and gasoline, said fuel additive being added to said fuel in an amount sufficient to reduce the pollutant emission levels of said combustible fuel.

9. A liquid fuel composition comprising a combustible liquid hydrocarbon and from 0.0001 to 0.1 weight percent alfalfa extract.

10. A liquid fuel according to claim 9 wherein said liquid fuel further comprises jojoba oil.

11. A liquid fuel according to claim 9 wherein said combustible liquid hydrocarbon is diesel fuel and said liquid fuel further comprises an effective amount of an alkyl nitrate cetane booster.

* * * * *